United States Patent [19]

Miles et al.

[11] Patent Number: 4,791,890

[45] Date of Patent: Dec. 20, 1988

[54] ENGINE COOLING SYSTEM POWER FLUSH WITH FLUSH LIQUID FILTERING AND RECIRCULATION

[75] Inventors: Gerald Miles, Fullerton; Rainer H. Labus, Burbank; James R. Grebe, Fullerton, all of Calif.

[73] Assignee: Wynn Oil Company, Fullerton, Calif.

[21] Appl. No.: 33,576

[22] Filed: Apr. 2, 1987

[51] Int. Cl.[4] ..... F28G 9/00; B08B 9/02; F01P 11/06

[52] U.S. Cl. ..... 123/41.14; 165/95; 134/111; 134/169 A

[58] Field of Search ..... 123/41.14; 165/95; 134/111, 169 A, 10, 21.12, 34

[56] References Cited

U.S. PATENT DOCUMENTS

| | | | |
|---|---|---|---|
| 1,701,824 | 2/1929 | Robinson | 134/34 X |
| 1,742,281 | 1/1930 | Rundlett | 165/95 |
| 3,094,131 | 6/1963 | Williams | 134/111 X |
| 3,115,145 | 12/1963 | Monteath, Jr. | 134/169 A X |
| 3,540,588 | 11/1970 | Estabrook | 134/111 |
| 3,954,611 | 5/1976 | Reedy | 134/169 A |
| 4,015,613 | 4/1977 | Papworth | 134/111 X |
| 4,029,115 | 6/1977 | Wheeler | 134/111 |
| 4,083,399 | 4/1978 | Babish et al. | 165/95 |
| 4,086,930 | 5/1978 | Hiss | 134/169 A X |
| 4,127,160 | 11/1978 | Joffe | 165/95 X |
| 4,128,140 | 12/1978 | Riches | 165/95 |
| 4,161,979 | 7/1979 | Stearns | 123/41.14 |
| 4,167,193 | 9/1979 | Magnus et al. | 134/169 A X |
| 4,176,708 | 12/1979 | Joffe | 165/95 |
| 4,293,031 | 10/1981 | Babish et al. | 165/95 |
| 4,343,353 | 8/1982 | Tsopelas | 165/95 |
| 4,366,069 | 12/1982 | Dudrey et al. | 134/169 A |
| 4,390,049 | 6/1903 | Albertson | 134/169 A X |
| 4,606,363 | 8/1986 | Scales | 134/111 |
| 4,671,230 | 6/1987 | Turnipseed | 134/169 A X |

*Primary Examiner*—Ira S. Lazarus
*Assistant Examiner*—Peggy Neils
*Attorney, Agent, or Firm*—William W. Haefliger

[57] ABSTRACT

A method of flushing an engine cooling system that includes a liquid coolant heater, radiator and liquid coolant pump, includes:

(a) producing a pressurized flow of flushing liquid and entrained gas bubbles, (b) selectively passing the flow through the radiator, and heater liquid pump; and receiving the flow discharged therefrom;

(c) filtering the received flow, and (d) re-circulating the flow, under pressure, to assist in the (a) step. Anti-freeze may be added to the circulating flow; and air is typically released from the received flow.

9 Claims, 7 Drawing Sheets

FILTER
PUMP
303
30

4
6
5
210
212
211
231
56
57
59
225
56a
58
63
230
64

219a
210
219
220
214
56
211
218
225
217
227
228
226
56a
229
63
230
215
221
210a
64

75
77
71
30
70
72

7
7

ENGINE COOLING SYSTEM POWER FLUSH WITH FLUSH LIQUID FILTERING AND RECIRCULATION

BACKGROUND OF THE INVENTION

This invention relates generally to flushing of internal combustion engine liquid cooling systems; more particularly, it concerns an air pressure assisted flushing of such systems wherein air bubbles entrained in flushing liquid act to efficiently scavenge or scrub scale and rust from coolant passages.

Studies show that over-heating is a major cause of vehicle breakdowns on highways. Engine cooling systems must operate efficiently at all times to avoid costly repairs that result from excessive temperature. In this regard, cooling systems contaminated by rust, scale build-up and sludge cannot provide adequate heat transfer and cooling system efficiency; in addition, thermostats fail to open, hoses deteriorate, impellers bind or break-off, and engine blocks can become distorted or crack. Accordingly, there is a need for efficient engine cooling system flushing methods and apparatus; however, those with which we are familiar lack the unusually advantageous combinations of structure, modes of operation and results as are now afforded by the present invention. These methods and apparatus have to do with preventing or minimizing contamination of the external environment during drainage of the flushed liquid from the engine cooling system.

SUMMARY OF THE INVENTION

It is a major object of the invention to provide improved flushing apparatus characterized as overcoming the problems discussed above and the disadvantages of prior flushing techniques. Basically, the invention employs the combined forces of controlled pressurized water and air turbulence to effect efficient flushing and cleaning of internal combustion engine liquid cooling systems including both the horizontal and vertical flow radiators. The improved apparatus comprises:

(a) first means to produce a pressurized flow of flushing liquid and entrained gas bubbles, (b) a series of flow ports selectively connectible to different points in said system, utilizing appropriate adaptors and (c) control means operable to direct said flow from said first means and via said ports in different modes relative to said radiator and to coolant passages in the engine, the improvement comprising:

(d) means to receive said flow after it passes through at least one of the engine and radiator and to filter the received flow, and (e) means to re-supply said filtered flow to said first means.

As will appear, the referenced first means may typically include a pressurized coolant inlet port, a pressurized air inlet port, and ducting connected between said air and coolant inlet ports and an inlet port defined by a primary valve, and wherein said (e) means includes a duct connected with said pressurized coolant inlet port; also, the (e) means typically includes a pump having an outlet delivering pressurized coolant to said pressurized coolant inlet port.

It is a further object to provide control means including valving to direct the flow in separate modes identified as follows:

(i) through the radiator in a reverse direction, (ii) through the engine coolant passage in a reverse direction, (iii) through the radiator in a forward direction, (iv) through the engine coolant passage in a forward direction.

Additional means is advantageously provided for removing air bubbles from the flow re-supplied to said first means; and such additional means typically includes a tank connected to said (d) means to receive the flow, and wherein the flow is allowed to release air bubbles to atmosphere Also, control means is provided to control the flow to said tank and via (e) means to said first means.

The method of the invention basically comprises:

(a) producing a pressurized flow of flushing liquid and entrained gas bubbles, (b) selectively passing the flow through the radiator, heater liquid pump; and receiving the flow discharged therefrom;

(c) filtering the received flow, and (d) re-circulating the flow, under pressure, to assist in said (a) step.

As will be seen anti-freeze may be added to the flow being recirculated, and air bubbles may be released from such liquid prior to its return as input liquid As a result, contamination of the external environment is elevated or held to a minimum. The solid filter cake, at the filter, may be periodically removed, for disposal in a regulated or licensed disposal process.

DRAWING DESCRIPTION

FIG. 1 is a frontal elevation of flushing apparatus for an engine cooling system;

FIG. 1*b* is a diagram of an internal combustion engine cooling system;

FIG. 2 is a rear view of the FIG. 1 apparatus;

FIGS. 2*a* and 2*b* are schematic views of flush liquid circulation during radiator flushing (FIG. 2*a*) and during heater and engine block flushing (FIG. 2*b*);

DETAILED DESCRIPTION

Figure 1:
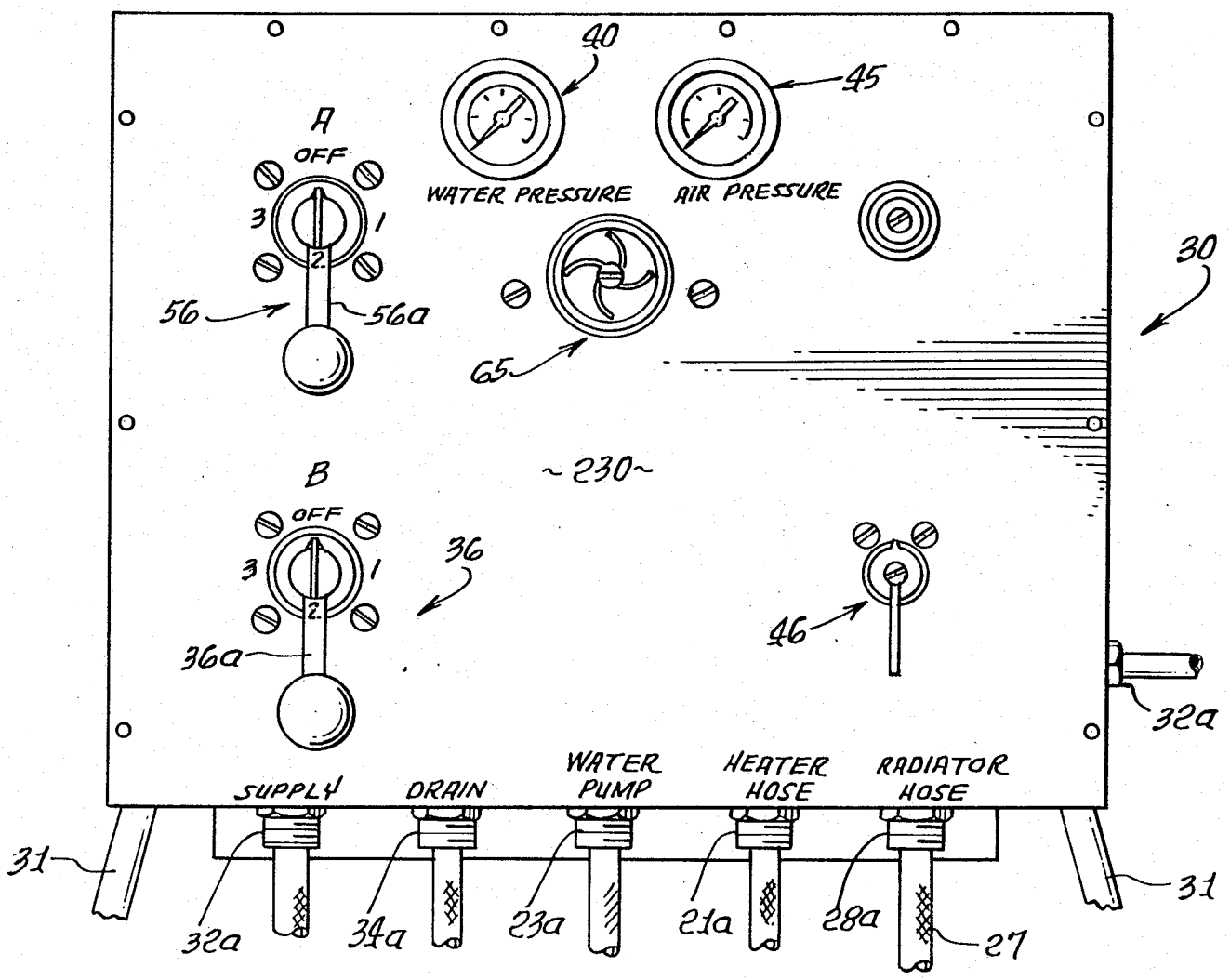
Figure 1B:
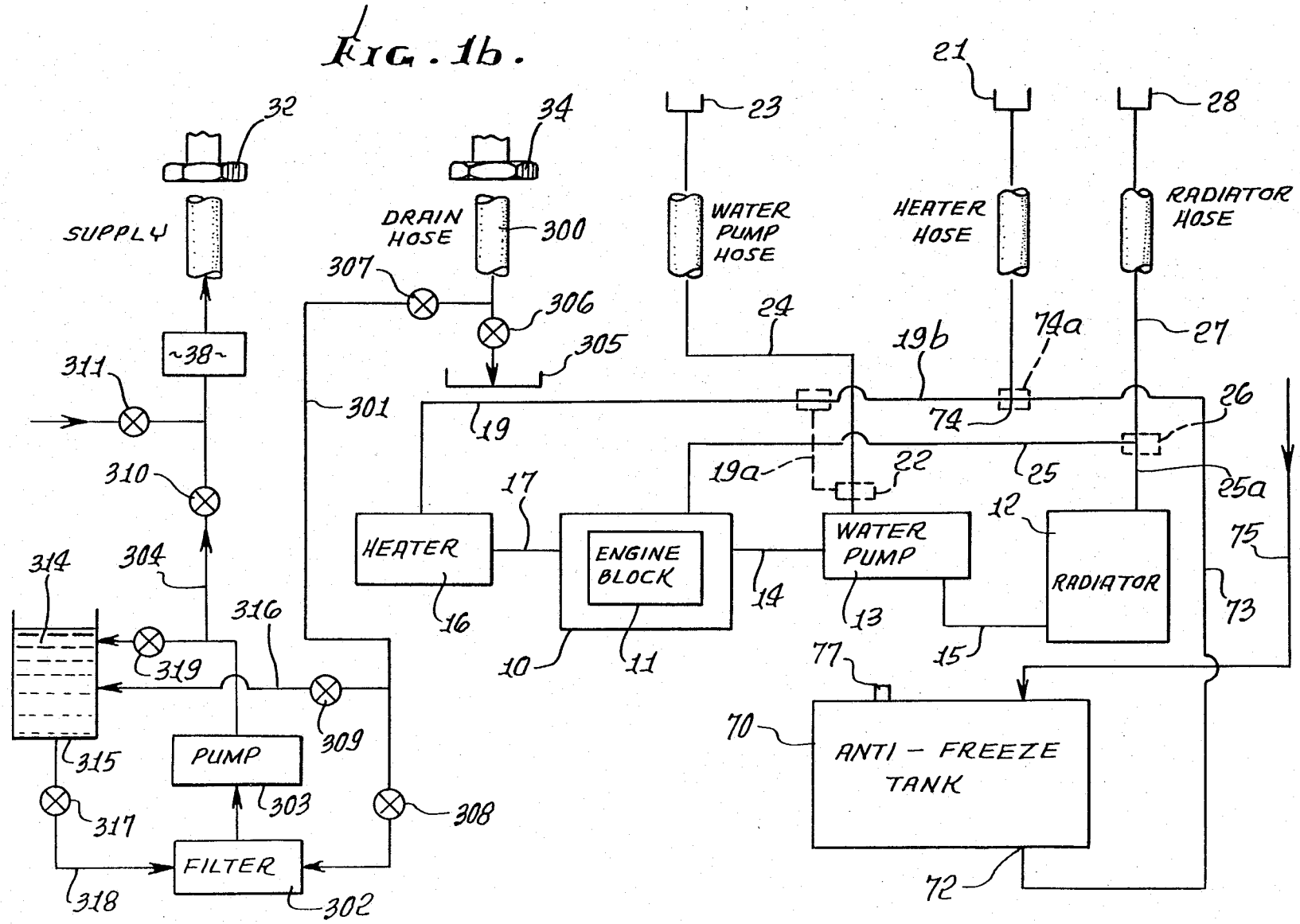

In FIG. 1*b* there are schematically shown an internal combustion engine 10 having a block 11 defining coolant passages through which liquid coolant (such as water) is adapted to pass; a radiator 12; and a coolant (i.e. water) pump 13 connected to pump coolant between the block and radiator, as via lines 14 and 15. Also shown is a heater 16 connected at 17 with the block 11 as for use in a vehicle to be heated. Normally, the water pump is connected with the heater via hoses 19 and 19*a*, however, the latter is shown as a broken line indicating that it is to be removed in accordance with the invention. The hose 19 is instead connected via coupling 19*c* with a hose 19*b* connected to a port 21 defined by the heater hose coupling 21*a* seen in FIG. 1. The water pump is then connected, (as for example at its intake) via adapter 22 and hose 24, with a port 23 defined by the water pump coupling 23*a* seen in FIG. 1. The connection to the water pump is typically at its intake side.

In addition, the upper radiator hose 25 is normally only connected with the engine block and radiator. A three-way adapter 26 is installed in hose 25 on horizontal flow radiators and another hose 27 connected between the adapter and a port 28 defined as by the radiator hose coupling 28*a* seen in FIG. 1. Hose extension 25*a* connects between the adapter 26 and the top of the radiator at its upper end. On vertical flow radiators, adaptor 26 is installed in the radiator filler neck utilizing the adaptor modifiers provided and hose 27 connects between the adaptor and port 28, as will be later described. In that event, the hose 25 remains connected to the radiator upper interior. See also U.S. Pat. No. 4,083,399.

First means is provided to produce a pressurized flow of flushing liquid (such as water) and gas bubbles (such as air bubbles), and second means is connected between the first mean and the cooling system to controllably feed the flow to the system, whereby the scrubbing action of the collapsing and expanding gas bubbles and flushing liquid efficiently removes scale and rust from the system during successive flushing cycles. For example, control means is provided and is typically operable to direct such flow from the first means and via the ports, in four separate modes, identified as follows:

(i) through the water pump and radiator in a reverse direction,
(ii) through the heater, engine coolant passages and water pump in a reverse direction,
(iii) through the radiator and water pump in a forward direction,
(iv) through the water pump, engine coolant passages and heater in a forward direction.

Such modes ensure that rust and scale removed from either one of the radiator, heater or engine does not clog or remain in the other during flushing.

A console is typically provided as at 30 to carry the first means, ports and control means, and may be suitably supported as by legs 31 so that the console is at best working level relative to the engine and radiator, as on a vehicle. In addition to the first port (such as defined at 28 by coupling 28*a*) selectively connected to the radiator, the second port (such as defined at 21 by coupling 21*a*) selectively connected with the heater, and the third port (such as defined at 23 by coupling 23*a*). The console may also carry a fourth port 32 defined by coupling 32*a*, a fifth port defined by coupling 33*a*, and a drain port 34 defined by coupling 34*a*

Figure 2:
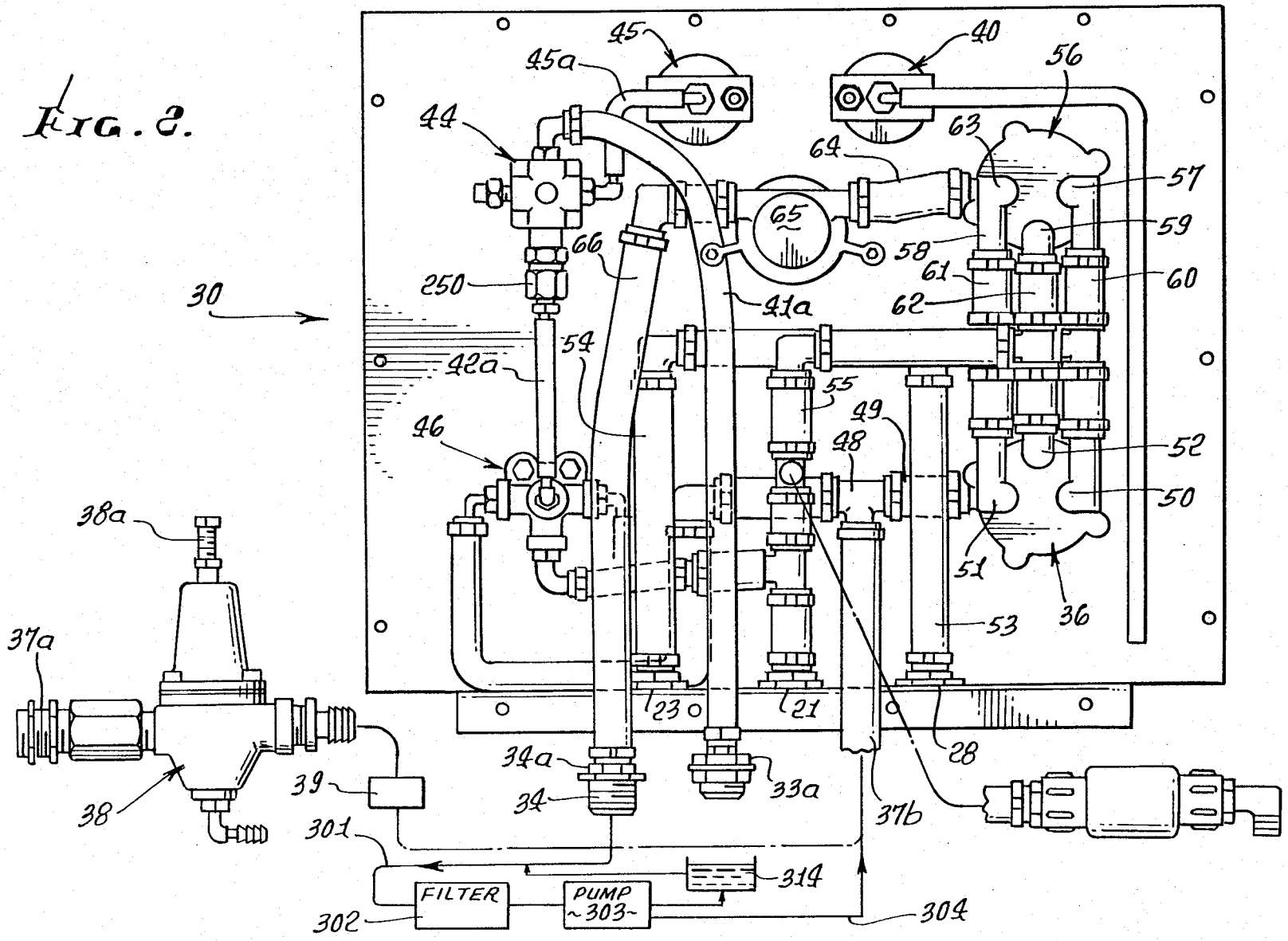
Figure 2A:
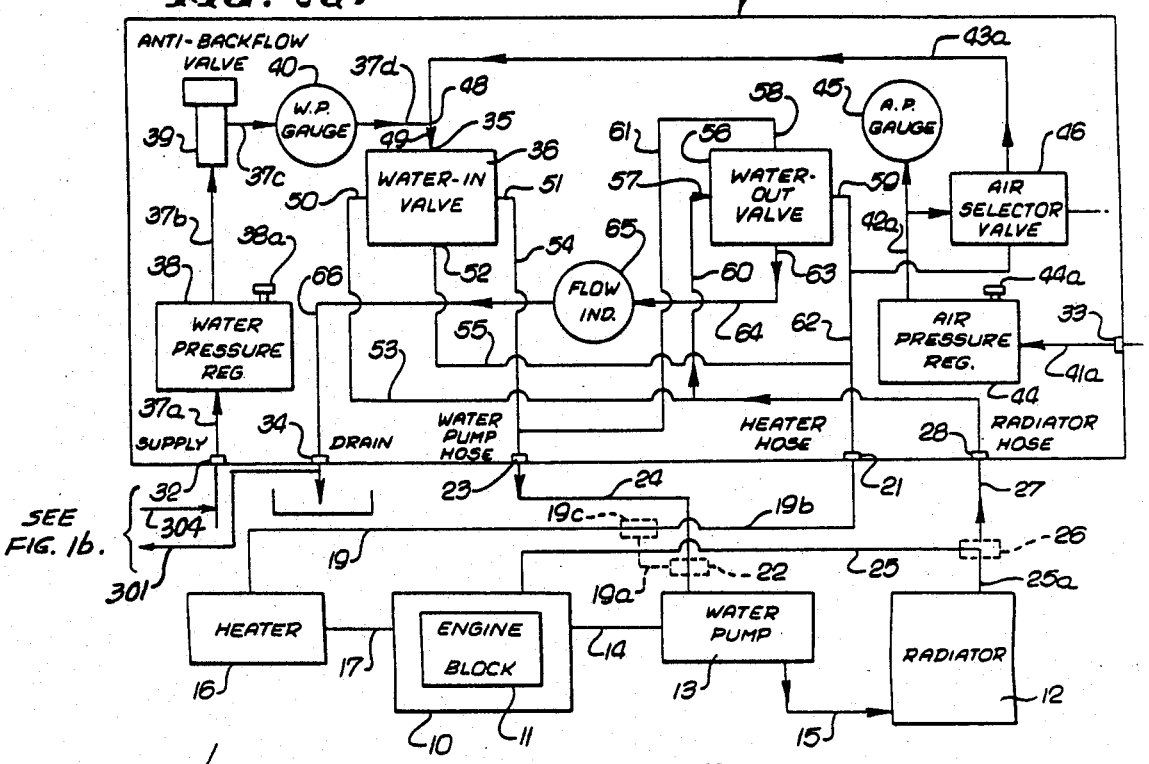
Figure 2B:
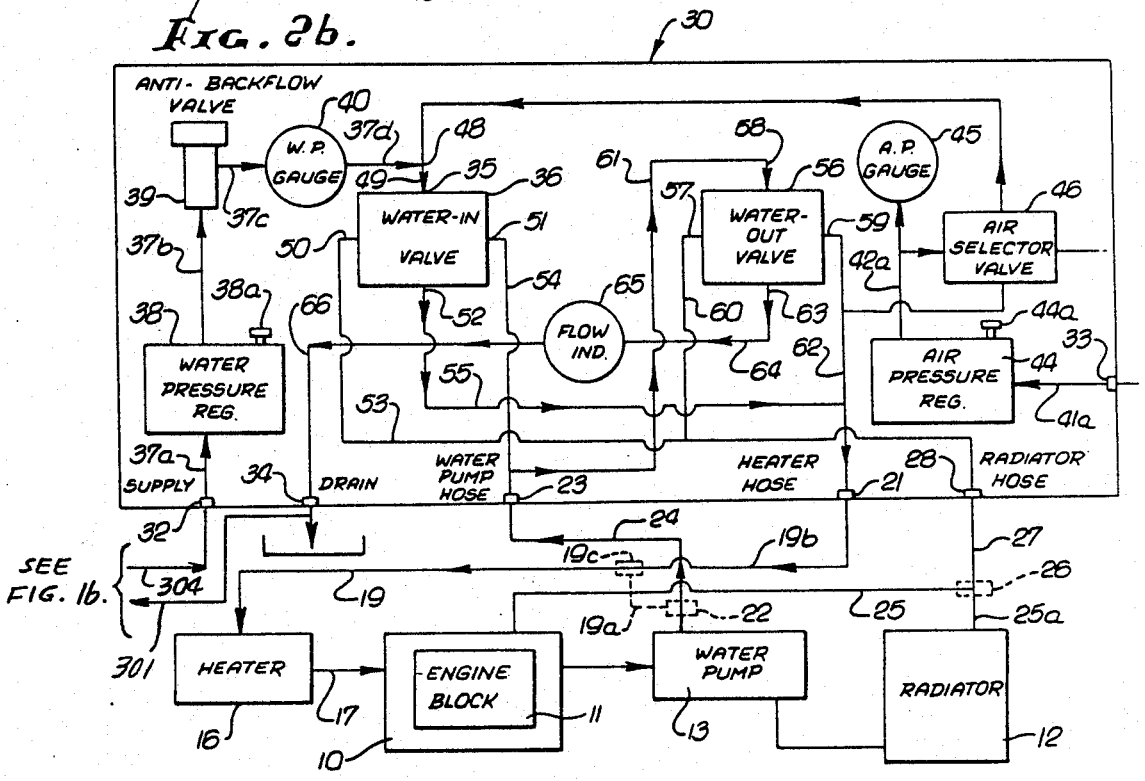

The first means to produce the pressurized flow of flushing liquid and entrained gas bubbles may be considered to include the water inlet port 32 (hose coupled at 32*a* to the console) the gas or air inlet port 33, and certain ducting. The latter is connected between such ports and an inlet port 35 defined by a primary valve 36. Such ducting is shown in FIG. 2*a* to include, for example, water supply ducts 37*a* and 37*b* with elements 38 and 39 connected in series therewith. Such elements include water pressure regulator 38 which is adjustable at 38*a* and an optional anti-back flow valve 39. As seen in FIG. 2*a*, a water pressure gage 40 may be connected to the regulator via line 37*d* to indicate regulated pressure. The ducting also includes, for example, pressurized air supply ducts 41*a*–43*a* with elements 44 and 46 connected in series therewith. The latter elements include an air pressure regulator 44, delivering air at 42*a* to air selector valve 46. An air pressure gage 45 is connected at 45*a* to the regulator 44, to indicate regulated air pressure. With the valve 46 in the open flush position, number 1, air flows to mix at 48 with water, at the same adjustably regulated pressure, and flow at 49 to the inlet 35. One typical regulator 38 is Type E-41 produced by A. W. Cash Valve Mfg., Corp., Decatur, Ill. One typical regulator 44 is Type RO4 produced by C. A. Norgren Co., Littleton, Colo.

The control means may be considered to include primary valve 36 (water inlet valve) which has three outlets 50, 51 and 52 respectively connected with the first, second and third ports 28, 23 and 21, as via lines 53–55. In addition, the control means may advantageously include a secondary valve 56 having three inlets 57–59 also respectively connected with the first, second and third ports, as via lines 60–62. Valve 56 also has a discharge port 63 connected via lines 64, flow indicator 65 and line 66 with drain port 34. Indicator 65 may include a sight glass, with a vaned rotor that is turned by the flow.

Figures 4, 5, 6:
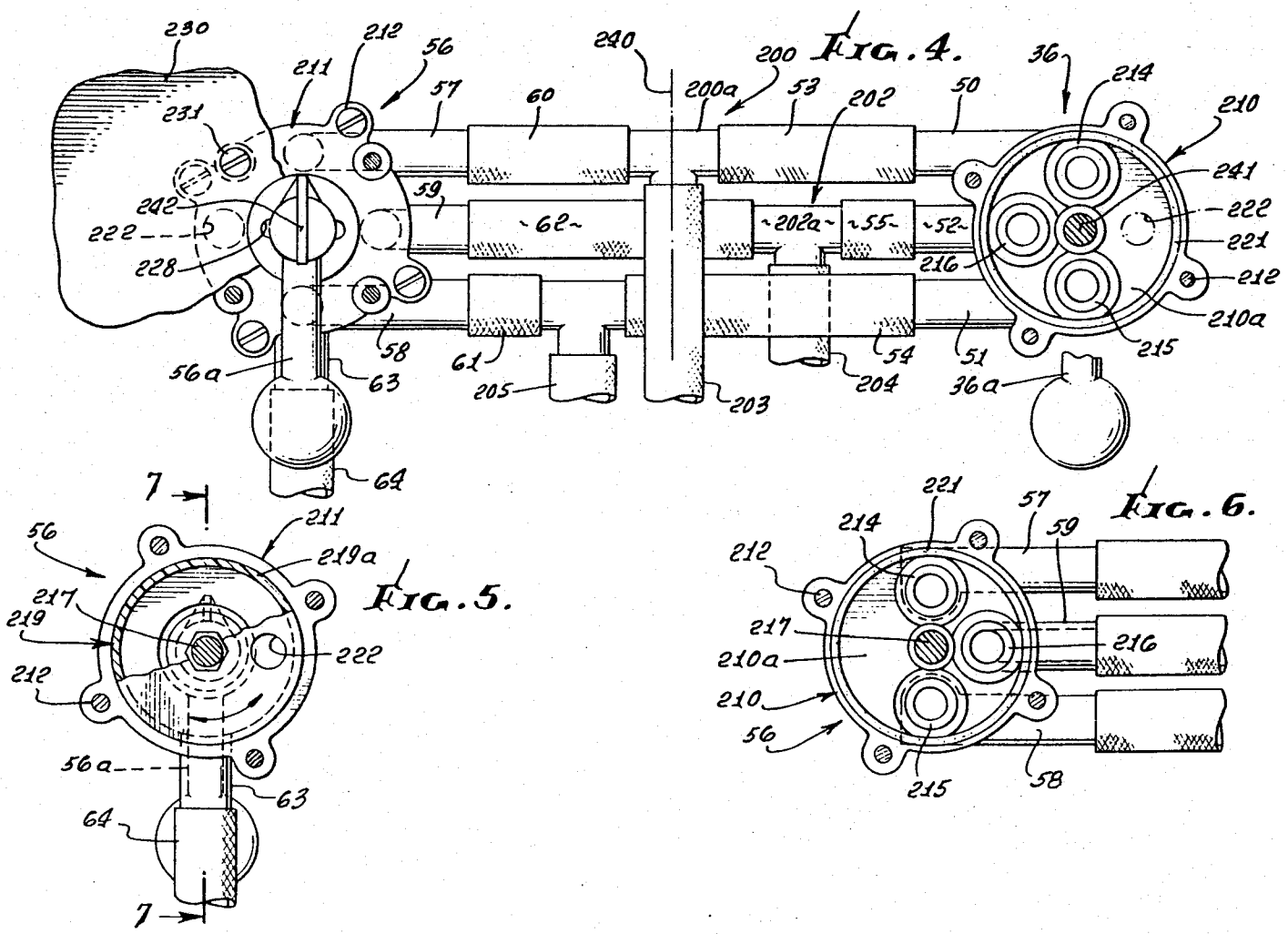
FIG. 4 is an enlarged elevation taken on lines 4—4 of FIG. 3.
FIG. 5 is a section on lines 5—5 of FIG. 3.
FIG. 6 is a section on lines 6—6 of FIG. 3.
Figure 9:
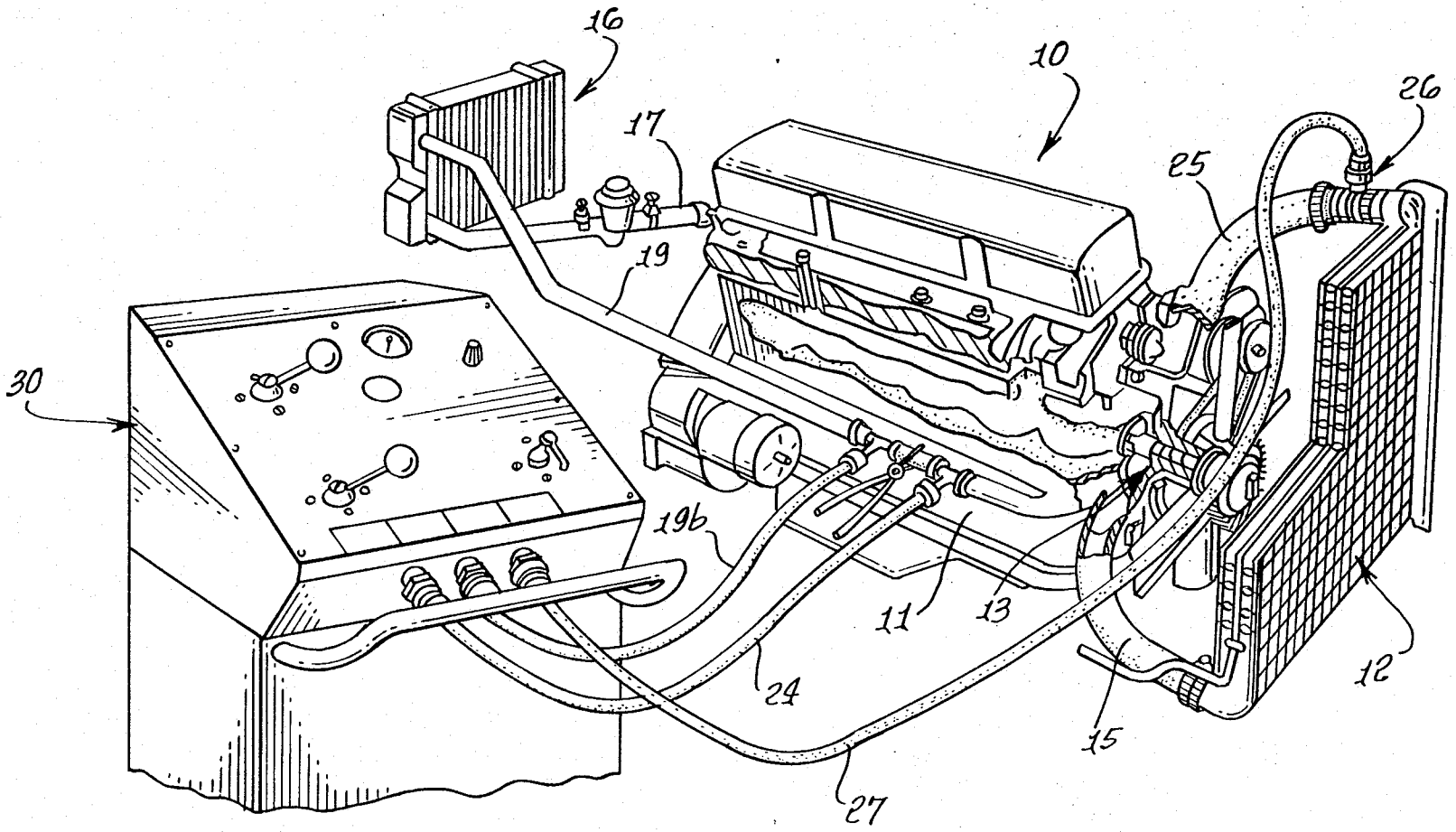
FIG. 9 is an overall perspective view of a system incorporating the invention.

The three outlets 50–52 of the primary valve 36 typically respectively directly communicate with the three inlets 57–59 of the secondary valve 56, via first, second and third ducts. For example, as seen in FIG. 4 the first duct includes sections 53 and 60 plus a section 200*a* of tee 200; the second duct includes sections 55 and 62 plus a section 202*a* of a tee 202; and the third duct includes sections 54 and 61 plus a section 201*a* of a tee 201. Also, the first, second and third ducts are respectively connectible with first, second and third ports; for example, the side branch of tee 200 and hose 203 connect the first duct with a first port such as at 28 (the radiator connection); the side branch of tee 202 and hoses 204 and 204*a* connect the second duct with a second port such as at 21 (the heater hose connection); and the side branch of tee 201 and hose 205 connect the third duct with a third port such as at 23 (the water or coolant pump connection). The three ducts as defined, and interconnecting the two valves 36 and 56 extend in generally parallel relation directly between the valves, whereby, they have minimum length, and the three tees 200, 202 and 201 provide branch outlets to which the three ports 28, 21 and are respectively connected. Accordingly, the duct sections 53, 60, 55, 62, and 54 and 61, as well as hoses 203, 204, 204*a* and 205 have minimum length and may consist of low cost tubular plastic material, as shown, facilitating installation, use and repair as required.

Also, the two valves 36 and 56 may then be alike and symmetrically arranged to facilitate ease and simplicity of valve position selection, as via rotatable position selectors (i.e. handles) having clock angles which are alike in their "first", "second" and "third" orientation. Since the valves are alike, and may consist of molded plastic material, cost is minimized. See for example FIG. 1, and the corresponding positions of rotary selectors 36*a* and 56*a*, tabulated as follows:

| Valve Selector | Selector Position | Clock Position |
|---|---|---|
| 56a | OFF | 12 o'clock |
| 36a | OFF | 12 o'clock |
| 56a | 1 | 3 o'clock |
| 36a | 1 | 3 o'clock |

-continued

| Valve Selector | Selector Position | Clock Position |
|---|---|---|
| 56a | 2 | 6 o'clock |
| 36a | 2 | 6 o'clock |
| 56a | 3 | 9 o'clock |
| 36a | 3 | 9 o'clock |

Figure 3:
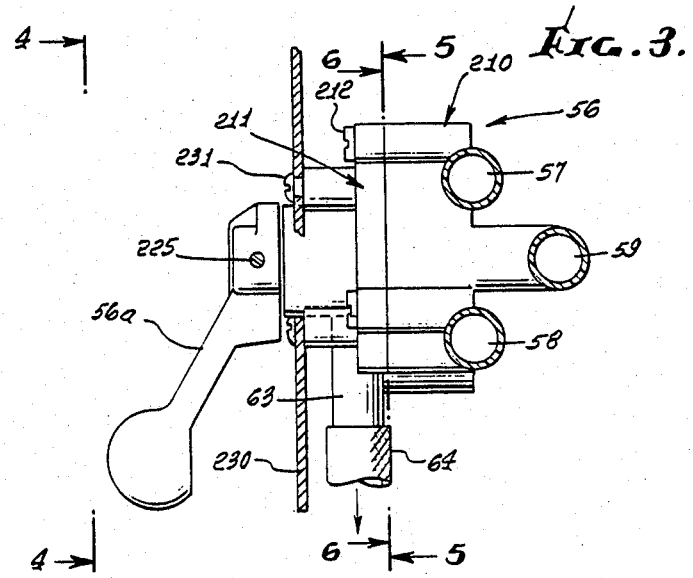
FIG. 3 is an enlarged sectional elevation taken on lines 3—3 of FIG. 2.
Figure 7:
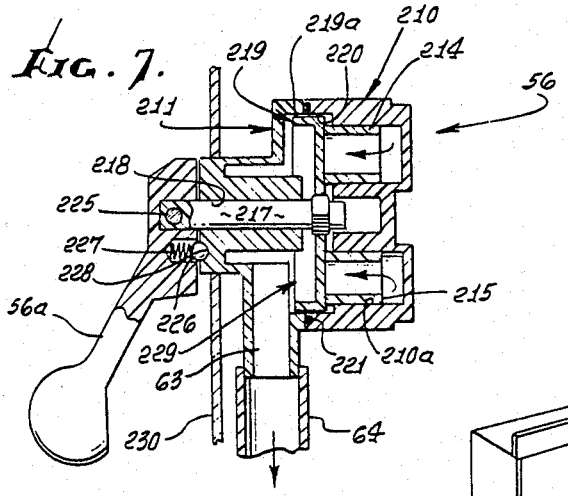
FIG. 7 is a section taken in elevation on lines 7—7 of FIG. 5.

The details of one of the two like valves 36 and are shown in FIGS. 3 & 7. As there illustrated, valve 56 includes a valve body 210 and a cap 211 bolted at 212 to the body. The body contains a chamber 210*a* wherein three separate tubular sleeves 214–216 are located, the sleeves having parallel axes, and respectively communicating with ports 57, 59 and 58. A stem 217, rotatable in bore 218 in the cap carries a disc 219 having an outer annular flange 219*a* rotatable in bore 220. An O-ring seal 221 seals against that flange. As seen in FIG. 7, the ends of sleeves 214–216 seal against the face of disc 219. An opening 222 in the disc 219 is selectively registrable with the sleeves 214–216 as the handle or selector is turned in sequence into the "1", "2" and "3" positions. In FIG. 5, the handle is in OFF position, so that opening 222 is out of registration with the sleeves, i.e. lies opposite the interior 210*a* of the body 210. Handle 56*a* is suitably connected at 225 with the stem 217, and a ball detent 226, spring urged at 227, is carried by the handle to seat in detent openings 228 in the cap at the selected valve handle positions. Water passing through the opening 222 flows via passage 229 to outlet 63 and hose 64. The valve cap is suitably mounted to the console front panel 230, as indicated at 231.

Valve 36 may advantageously have the sam construction as valve 56, excepting that the three outlets 50, 52 and 51 of valve 36 and the three inlets 60, 62 and 61 of valve 56 are respectively symmetrically located with respect to a plane parallel to the two spaced, parallel axes of the valve rotors (i.e. stems), that plane bisecting the space between such axes. See plane 240 in FIG. 4, and valve rotor axes 241 and 242 in that view. For simplicity, the cap 211 of valve 36 is rotated 180° relative to the body 210 of that valve, as compared to the positions of these elements in valve 56; also, the handle 56*a* is then rotated 180° relative to the position of the cap.

In operation the valves 36 and 56 are both turned to "1" position in FIG. 1 and the air selector valve 46 is turned to "1" (FLUSH) position, to supply air to the water inlet flow. As the radiator and water pump are flushed in a reverse direction, the sight glass at 65 may be observed to note flow of scale and other particles toward the drain. After the flow at 65 becomes clear, the valves 36 and 56 are respectively turned to "2" and "3" positions in FIG. 1, whereby the flow is directed reversely through the heater, engine coolant passages, and water pump and the sight glass again observed. After the flow becomes clear, the valves 36 and 56 are located at "3" positions in FIG. 1 whereby the radiator and water pump are flushed in a forward direction, and the sight glass again observed; after the flow becomes clear, the valves 36 and 56 are respectively turned to "1" and "2" positions in FIG. 1, whereby the water pump, engine coolant passages and heater are flushed in a forward direction. Finally, after the flow becomes clear, the valves are turned toward the OFF position.

In accordance with an important aspect of the invention, means is provided to receive the flow of flushing liquid and entrained gas bubbles after it has passed through at least one of the engine and radiator, and to filter that flow (instead of passing the contaminated flow to drain); and means is also provided to supply the resultant filtered flow back to the means which in the first instance produces the pressurized flow of flushing liquid and entrained gas bubbles.

Referring to FIG. 1, the means to receive and filter the flow of flushing liquid and entrained gas bubbles may include a line 301 receiving the flow from drain hose 300 connected to drain fitting 34 (in FIG. 2*a*), and a filter 302; and the means to supply the filtered flow to the supply fitting 32 includes a pump 303 taking suction from the filter, and discharging to line 304 connected to fitting 32. As a result, no contaminated drain flow from the engine 10 or heater 16, or water pump 13, or radiator 12, flows to sewer drain or sump 305, whereby environmental objections are met and environmental regulations complied with. To this end, valves 307, 308, and 310 are open; valve 306 to drain sump 305 is closed, and external water supply valve 311 is closed. Any liquid anti-freeze such as ethylene glycol flowing to drain hose 300 is re-circulated via the water supply to the water intake, including regulator 38,. Alternately, some or all the draining liquid may be discharged to the sump 305, as by opening valve 306 to varying extent, and closing valve 307 to varying extent; and some or all of the liquid supplied to the regulator may comprise fresh water, as by variably opening valve 311 and variably closing valve 310.

Finally, residual air bubbles in the contaminated drain fluid may be released to atmosphere as in a bath 314 into which the drain liquid is supplied via line 316, valve 309 being opened, and valve 308 closed. From tank 315, liquid flows via opened valve 317 and line 318 to the filter 302. Rather than supplying contaminated drain liquid and air bubbles to the tank, filtered liquid and bubbles may be supplied to the tank via the pump discharge and the valve 319, for release of air bubbles. Valve 309 at that time may be closed. The hoses 24, 19*b* and 27 are then disconnected, and the hose 19 is connected to the water pump 13 at 19*a*. Hose 25 is reconnected to radiator 12 and the vehicle is then ready for drive away.

Anti-freeze may be added, if required prior to disconnecting hoses 24, 19*b* and 27. To evacuate the system of water, valves 36 and 56 are respectively turned to positions "OFF" and "3". Valve 46 is then turned to drain (position 3) and the air regulator 44 is adjusted to pressurize the system, forcing the water out through hose 19, heater 16, engine block 11, water pump 13, hose 205, valve 56 hoses 64, flow indicator 65 and hose 66 and to drain, or to re-circulate via 301, 302, 303 and 304.

Figure 8:
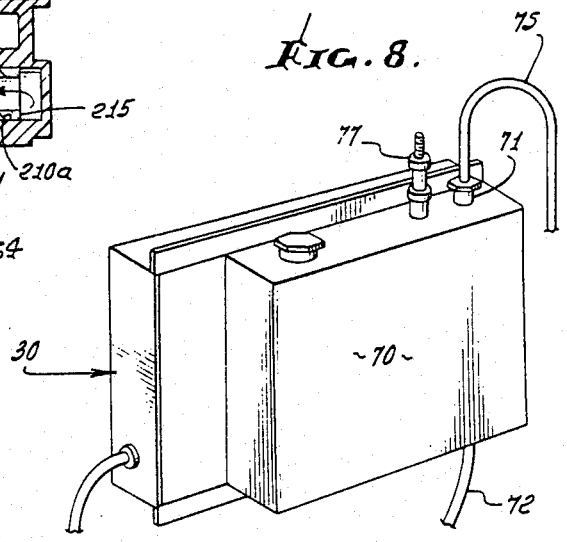
FIG. 8 is a perspective view showing an anti-freeze supply tank associated with the FIG. 1 and FIG. 2 apparatus.

Referring to FIGS. 1*b* and 8, supplied air pressure is employed to displace anti-freeze or coolant into the coolant system. For this purpose, an anti-freeze liquid container 70 may have an inlet 71 selectively connected with air inlet port as via the selector valve 46. The container bottom outlet 72 is connected with the coolant system, as for example by hose 73 connected with hose 19 at point 74, a suitable valve and adapter 74*a* being provided. When the valve 46 is turned to "INJECT" (position 2) as seen in FIG. 1, the air flow in FIG. 1*b* proceeds via line 75 to displace anti-freeze from the tank 70. The liquid flows at 73 and 19 into the system via the heater, displacing water from the heater 16, engine block 10, and radiator 12, through the secondary valve 56 and to the drain. Valve 36 is in OFF position, and valve 56 in position "1" in FIG. 1, at this time.

When tank 70 is empty, or the proper amount of anti-freeze has entered the system the valve 74*a* and valve 46 may be returned to OFF position in FIG. 1. A relief valve 77 is installed on tee tank to relieve air pressure over about 5 psi.

Tank or container 70 may be mounted at the back side of the console 30, as indicated at FIG. 8. Tank 70 preferably consists of plastic.

Referring back to FIG. 2, a check valve 250 is connected in series with the duct 42*a*, and between regulator 44 and valve 46, to prevent back-flow of water to the regulator 44.

Valves 36 and 56 are produced by Barksdale Control Division, De Laval Turbine Inc., Los Angeles, Calif.

We claim:

1. In combination with an internal combustion engine cooling system that includes a liquid coolant heat radiator and liquid coolant pump, flushing apparatus comprising:

(a) first means to produce a pressurized flow of flushing liquid and entrained gas bubbles, (b) a series of flow ports selectively connectible to different points in said system, utilizing appropriate adaptors and (c) control means operable to direct said flow from said first means and via said ports in different modes relative to said radiator and to coolant passages in the engine, the improvement comprising:

(d) filter means having an intake to receive said flow after it passes through at least one of the engine and radiator and to filter the received flow, (e) means including a pump having an intake operatively connected with the filter means to receive filtered flow therefrom, and having a discharge directly connected to said first means, (f) and additional means for removing air bubbles from the flow re-supplied to said first means, said additional means including a tank having an inlet to directly receive the flow from the pump, and wherein the flow is allowed to release air bubbles to atmosphere, the filter means being outside liquid in the tank, and including a line connecting the tank to the filter means to pass liquid from the tank to the filter means intake, (g) said additional means including additional lines to directly and controllably supply the flow, after it passes through at least one of the engine and radiator, to each of:

(i) the filter means intake, an (ii) said tank.

2. The apparatus of claim 1 wherein said first means includes a pressurized coolant inlet port, a pressurized air inlet port, and ducting connected between said air and coolant inlet ports and an inlet port defined by a primary valve, and wherein said (e) means includes a duct connected with said pressurized coolant inlet port.

3. The combination of claim 2 wherein said pressurized coolant includes liquid anti-freeze.

4. The combination of claim 3 wherein said anti-freeze consists essentially of ethylene glycol.

5. The combination of claim 1 wherein said control means includes valving to direct the flow in separate modes identified as follows:

(i) through the radiator in a reverse direction, (ii) through the engine coolant passage in a reverse direction, (iii) through the radiator in a forward direction, (iv) through the engine coolant passage in a forward direction.

6. The apparatus of claim 1 including a console carrying said control means, flow ports, said (d) means and said (e) means.

7. The apparatus of claim 1 including said engine cooling system, and including hoses connecting said ports with the radiator, and pump respectively.

8. The apparatus of claim 1 wherein said ports include a drain port, and said (d) means is connected with said drain port.

9. The apparatus of claim 1 including control valve means to control the flow to said tank, and via e) means to said first means, and also including a control valve in series with the line connecting the tank to the filter means to control the flow of tank liquid to the filter means.

* * * * *